US009814329B2

(12) United States Patent
Mitchell et al.

(10) Patent No.: US 9,814,329 B2
(45) Date of Patent: Nov. 14, 2017

(54) QUILT

(71) Applicant: Exxel Outdoors, LLC, Boulder, CO (US)

(72) Inventors: Kelsie Mitchell, Mays Landing, NJ (US); Casey Sumnicht, Longmont, CO (US)

(73) Assignee: Exxel Outdoors, LLC, Boulder, CO (US)

( * ) Notice: Subject to any disclaimer, the term of this patent is extended or adjusted under 35 U.S.C. 154(b) by 0 days.

(21) Appl. No.: 14/244,172

(22) Filed: Apr. 3, 2014

(65) Prior Publication Data

US 2014/0352063 A1 Dec. 4, 2014

Related U.S. Application Data

(60) Provisional application No. 61/828,351, filed on May 29, 2013.

(51) Int. Cl.
*A47G 9/02* (2006.01)
*A47G 9/08* (2006.01)

(52) U.S. Cl.
CPC ..... *A47G 9/0223* (2013.01); *A47G 9/0207* (2013.01); *A47G 9/086* (2013.01)

(58) Field of Classification Search
CPC ..... A47G 9/0223; A47G 9/02; A47G 9/0207; A47G 9/023; A41B 13/06
See application file for complete search history.

(56) References Cited

U.S. PATENT DOCUMENTS 1,610,799 A 3/1925 Lack et al.
2,537,537 A 1/1951 Ljungberg
(Continued)

FOREIGN PATENT DOCUMENTS

CN 2199725 Y 6/1995
CN 201894435 U 7/2011
(Continued)

OTHER PUBLICATIONS

International Search Report and Written Opinion for PCT/US2014/032752 dated Sep. 26, 2014; 10 pages.
(Continued)

*Primary Examiner* — David E Sosnowski
(74) *Attorney, Agent, or Firm* — Stinson Leonard Street LLP

(57) ABSTRACT

A quilt has a pair of longitudinally extending side edges, a pair of laterally extending end edges, a head portion, a foot portion, and a middle portion extending longitudinally between the head and foot portions. The quilt includes a hood box adapted to receive and surround the head of the user during use of the quilt. The hood box is disposed in the head portion and includes a front hood panel and a back hood panel. The front hood panel has an aperture moveable between a closed position and an opened position for allowing at least a portion of the user's face to be exposed during use of the hood box. The quilt also includes a pair of overlapping portions. One of the overlapping portions extends along one of the longitudinal side edges and the other overlapping portion extends along the other longitudinal side edge. Each of the overlapping portion define a hand pocket sized and shaped for receiving a hand of the user and an arm receptacle sized and shaped for receiving at least a portion of the user's arm.

14 Claims, 15 Drawing Sheets

(56) References Cited

U.S. PATENT DOCUMENTS

| | | | | |
|---|---|---|---|---|
| 2,757,390 | A * | 8/1956 | Miller | 5/413 R |
| 3,633,227 | A * | 1/1972 | Tegeler | 5/413 R |
| 3,798,676 | A | 3/1974 | Shanks et al. | |
| 4,158,892 | A * | 6/1979 | Gonzales | 2/69.5 |
| 4,573,217 | A * | 3/1986 | Reed | 2/7 |
| 4,752,971 | A | 6/1988 | Meserol | |
| 4,787,105 | A * | 11/1988 | Phillips et al. | 5/413 R |
| 4,989,282 | A * | 2/1991 | Goldstein | 5/413 R |
| 4,996,733 | A * | 3/1991 | Tsai | 5/413 R |
| 5,044,031 | A * | 9/1991 | Sherwood et al. | 2/69.5 |
| 5,257,427 | A | 11/1993 | Hinshaw | |
| 5,414,881 | A | 5/1995 | Terrazas | |
| 5,875,492 | A | 3/1999 | Moss | |
| 5,881,405 | A * | 3/1999 | Garrigues | 5/413 R |
| 5,960,492 | A | 10/1999 | Byrne | |
| 5,966,756 | A | 10/1999 | Cartier | |
| 6,006,360 | A * | 12/1999 | Reed | 2/202 |
| 6,223,367 | B1 * | 5/2001 | French et al. | 5/419 |
| 6,401,248 | B1 | 6/2002 | Christensen | |
| 6,408,462 | B1 | 6/2002 | Moore | |
| 6,708,343 | B1 | 3/2004 | Ceron | |
| 6,851,127 | B1 | 2/2005 | Khan | |
| 7,178,185 | B1 | 2/2007 | Nattler | |
| D569,159 | S | 5/2008 | Walker | |
| D586,537 | S | 2/2009 | Walker | |
| 7,587,769 | B1 | 9/2009 | McDermott | |
| D601,327 | S | 10/2009 | Anderson et al. | |
| 7,752,690 | B1 * | 7/2010 | Seth | 5/413 R |
| D629,176 | S | 12/2010 | Abrams et al. | |
| D654,248 | S | 2/2012 | Abrams et al. | |
| D675,810 | S | 2/2013 | Bridges | |
| 8,539,620 | B1 * | 9/2013 | Wynh | 5/494 |
| 8,707,481 | B1 * | 4/2014 | Juarez | 5/494 |
| D715,028 | S | 10/2014 | Harris | |
| D742,618 | S | 11/2015 | Sumnicht et al. | |
| 9,408,484 | B2 | 8/2016 | Schofield et al. | |
| 2001/0044964 | A1 | 11/2001 | Phillips | |
| 2003/0159192 | A1 | 8/2003 | La Scala | |
| 2004/0199998 | A1 | 10/2004 | Shinner | |
| 2005/0039241 | A1 | 2/2005 | Khan | |
| 2005/0283910 | A1 | 12/2005 | DuQue | |
| 2006/0200906 | A1 * | 9/2006 | Deering et al. | 5/482 |
| 2007/0136946 | A1 * | 6/2007 | Haislip | 5/413 R |
| 2008/0028518 | A1 * | 2/2008 | Miotke et al. | 5/482 |
| 2008/0066229 | A1 | 3/2008 | Auer et al. | |
| 2008/0078027 | A1 * | 4/2008 | Smith | 5/413 R |
| 2008/0222803 | A1 * | 9/2008 | Korshamn | 5/413 R |
| 2008/0235848 | A1 * | 10/2008 | Wilder et al. | 2/69.5 |
| 2010/0122395 | A1 | 5/2010 | Wall et al. | |
| 2010/0146680 | A1 | 6/2010 | Cuoco | |
| 2010/0170039 | A1 | 7/2010 | Davis | |
| 2010/0186166 | A1 | 7/2010 | Sulentic | |
| 2010/0205714 | A1 | 8/2010 | Pollack | |
| 2011/0023233 | A1 * | 2/2011 | Hilgeman, Jr. | 5/413 R |
| 2011/0258749 | A1 | 10/2011 | Hibbs | |
| 2012/0005801 | A1 | 1/2012 | Parr | |
| 2012/0110716 | A1 * | 5/2012 | Christensen et al. | 2/69.5 |
| 2012/0276802 | A1 * | 11/2012 | Anderman et al. | 446/27 |
| 2012/0284922 | A1 * | 11/2012 | Gangan et al. | 5/494 |
| 2012/0297539 | A1 | 11/2012 | Like et al. | |
| 2012/0311763 | A1 | 12/2012 | King | |
| 2013/0171906 | A1 * | 7/2013 | Smoot et al. | 446/73 |
| 2013/0239325 | A1 | 9/2013 | Kelkel et al. | |
| 2014/0020177 | A1 * | 1/2014 | Coates | 5/494 |
| 2014/0033395 | A1 * | 2/2014 | Torgersen | 2/69.5 |
| 2014/0150159 | A1 * | 6/2014 | Alluna | 2/69.5 |
| 2014/0165257 | A1 * | 6/2014 | Wynh | 2/69.5 |
| 2014/0298584 | A1 | 10/2014 | Sumnicht | |
| 2014/0352167 | A1 * | 12/2014 | Peters | 34/353 |
| 2015/0128345 | A1 | 5/2015 | Schofield et al. | |

FOREIGN PATENT DOCUMENTS

| | | | |
|---|---|---|---|
| CN | 201938912 | U | 8/2011 |
| CN | 202457520 | | 10/2012 |
| EP | 0314391 | A1 | 5/1989 |
| EP | 0761145 | A1 | 3/1997 |
| EP | 1472959 | A1 | 11/2004 |
| EP | 1600085 | A1 | 11/2005 |
| GB | 191411589 | A | 2/1915 |
| JP | 2006320690 | | 11/2006 |
| JP | 2011219881 | A | 11/2011 |

OTHER PUBLICATIONS

Gear:30: Sleeping Bag vs. Quilt, Blogspot.nl/2012/03/sleeping-bag-vs-quilt.html.

Not A Mummy: Zipper-less Design Offers New Sleeping Bag Experience, posted at gearjunkie.com, earliest date available Aug. 27, 2013, [online], acquired on Oct. 1, 2016. Available from Internet, <URL: https://gearjunkie.com/sierra-designsbackcountry-bed-sleeping-bag>.

How to Choose the Best Backpacking Sleeping Bag, posted at outdoorgearlab.com, earliest date available Dec. 2, 2014, [online], acquired on Oct. 1, 2016. Available from Internet, <URL: http://www.outdoorgearlab.com/Best-Backpacking-Sleeping-Bag/Buying-Advice>>.

A Sleeping Bag That Ditches Zippers So You Don't Feel Like a Mummy, posted at gizmodo.com, earliest date available Sep. 2, 2013, [online], acquired on Oct. 1, 2016. Available from Internet, <URL:http://gizmodo.com/a-sleeping-bagthat-ditches-zippers-so-you-dont-feel-1-1222575715>.

* cited by examiner

QUILT

CROSS-REFERENCE TO RELATED APPLICATION

This nonprovisional application claims priority to U.S. Provisional Patent Application Ser. No. 61/828,351, titled QUILT, filed on May 29, 2013, which is incorporated in its entirety by reference.

FIELD

The field of the disclosure relates generally to quilts. More particularly, this disclosure relates to a quilt having hand pockets, arm receptacles, a foot box and/or a hood box.

BACKGROUND

Typically, quilts are adapted to keep a user warm, especially while sleeping. While many quilts are intended for indoor use, some quilts are intended to be used outdoors by backpackers, hikers, campers, mountaineers, and other users as portable bedding or coverings. These types of quilts (i.e., outdoor quilts) are often durable, soft, warm (i.e., insulated) and weather resistant. Many backpackers, hikers, campers, mountaineers, and other users prefer quilts over conventional sleeping bags because they tend to be lighter in weight/volume and more comfortable. For one, quilts are substantially less restrictive during use than a convention sleeping bag (e.g., a mummy bag).

Often however, quilts do not provide the warmth found in sleeping bags. For example, conventional quilts typically do not wrap around the sides of the user but rather simply overlie the user during use. As a result, quilts are susceptible to drafts along its periphery. Moreover, conventional quilts are not intended to cover the head of the user. Rather, conventional quilts are intended to be drawn up to the neck of the user but not over the user's head. Thus, during the use of conventional quilts the user's head is exposed.

Accordingly, a need exists for a quilt that inhibits drafts along the periphery of the quilt and provides the option of covering the user's head during use of the quilt.

BRIEF DESCRIPTION

In one aspect, a quilt generally comprises a hood box having an opening sized and shaped for allowing a user's head to be placed into and withdrawn from the hood box and an aperture selectively moveable between a closed position and an opened position.

In another aspect, a quilt has a head portion, a foot portion, and a middle portion extending longitudinally between the head and foot portions. The quilt generally comprises a hood box adapted to receive and surround the head of the user during use of the quilt. The hood box is disposed in the head portion and includes a front hood panel and a back hood panel. The front hood panel has an aperture moveable between a closed position and an opened position for allowing at least a portion of the user's face to be exposed during use of the quilt.

In yet another aspect, a quilt has a pair of longitudinally extending side edges and a pair of laterally extending end edges. The quilt generally comprises a pair of overlapping portions. One of the overlapping portions extends along one of the longitudinal side edges and the other overlapping portion extends along the other longitudinal side edge. Each of the overlapping portion define a hand pocket sized and shaped for receiving a hand of the user and an arm receptacle sized and shaped for receiving at least a portion of the user's arm.

Various refinements exist of the features noted in the above-mentioned aspects. Further features may also be incorporated in the above-mentioned aspects. These refinements and additional features may exist individually or in any combination. For instance, various features discussed below in relation to any of the illustrated embodiments may be incorporated into any of the above-described aspects, alone or in any combination.

DETAILED DESCRIPTION OF THE DRAWINGS

Figure 1:
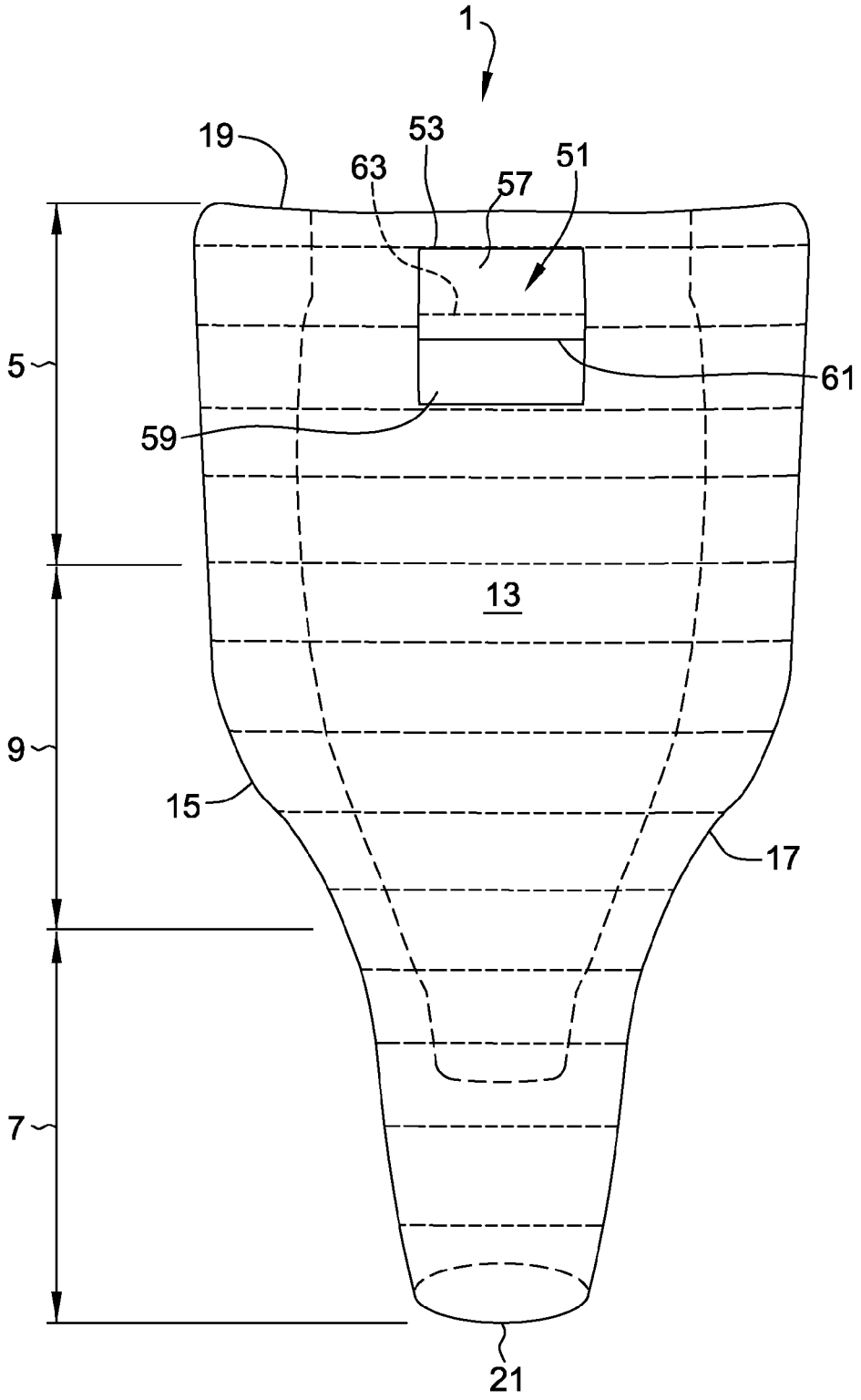
FIG. 1 is a top plan view of one embodiment of a quilt.
Figure 2:
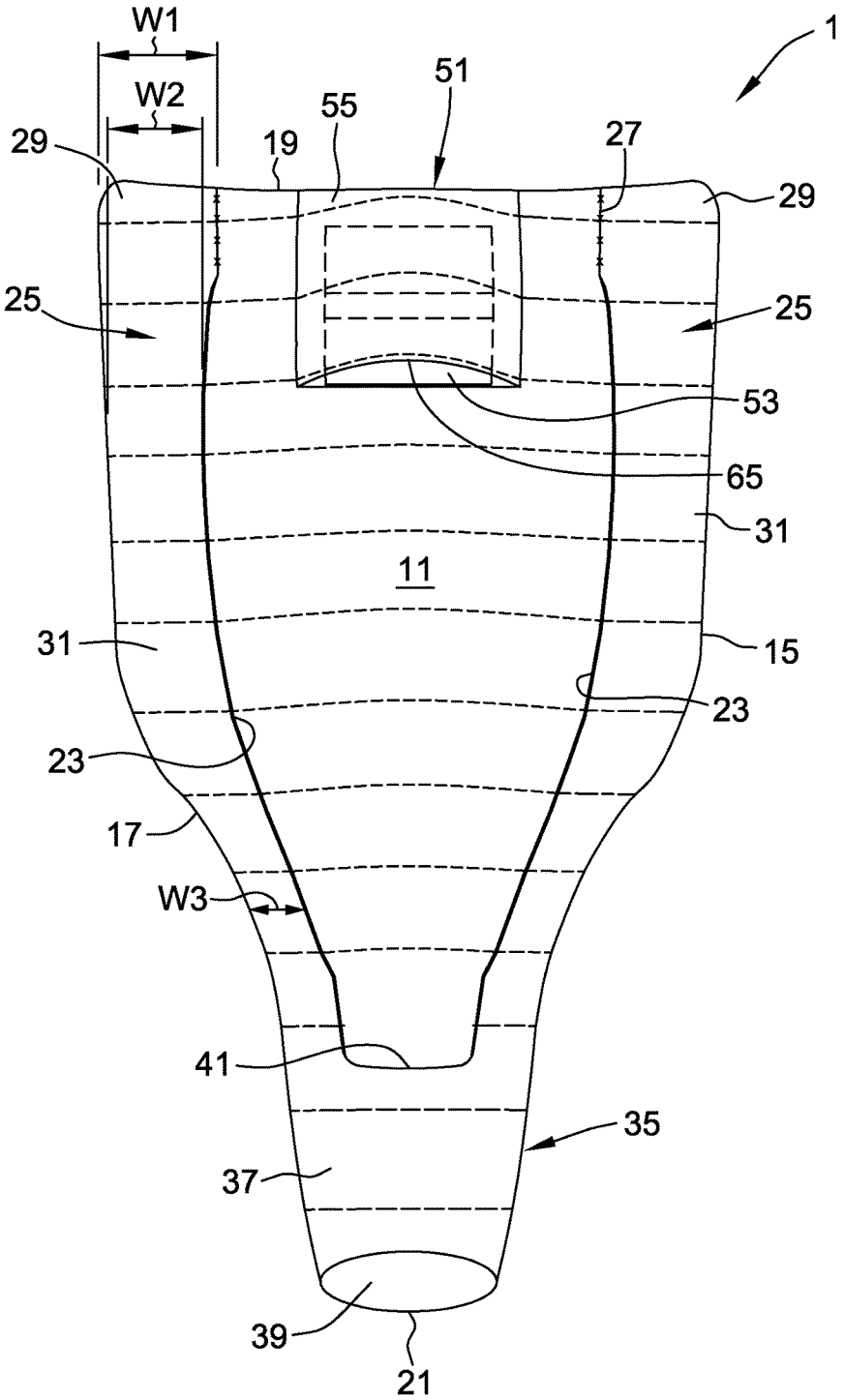
FIG. 2 is a bottom plan view of the quilt of FIG. 1.
Figure 3:
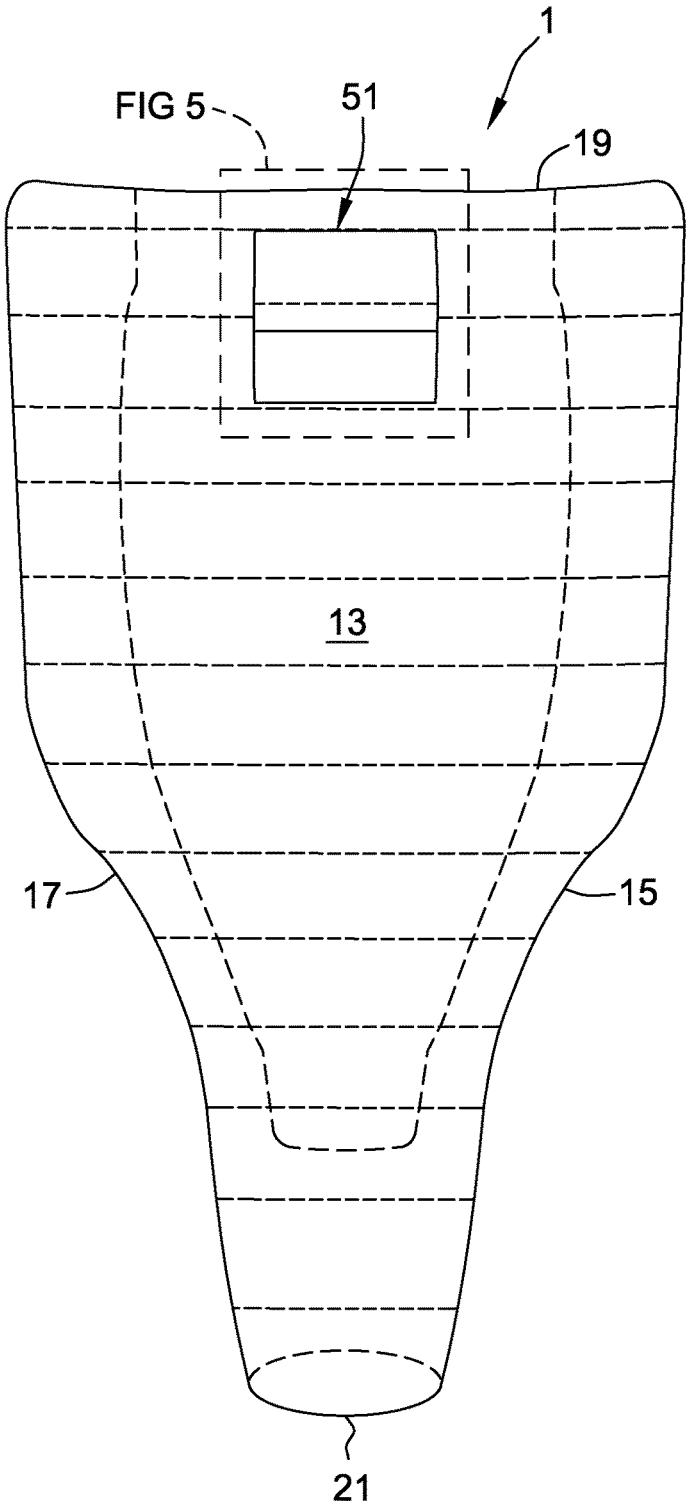
FIG. 3 is another top plan view of the quilt of FIG. 1.

Referring now to the drawings and in particular to FIGS. 1-13, one embodiment of a quilt is designated in its entirety by the reference number 1. The quilt 1 has a head portion 5, a foot portion 7, and a middle portion 9 extending longitudinally between the head and foot portions (FIG. 1). As seen in FIGS. 1 and 2, the illustrated quilt 1 tapers from the head and middle portions 5, 9 toward the foot portion 7 to generally conform to the contours of the user. That is, the quilt 1 is broadest in the region corresponding to the shoulders of the user and narrowest or tapered in the region corresponding to the feet of the user. It is understood, however, that in other embodiments the quilt could have less or greater taper than shown in FIGS. 1 and 2. For example, in one suitable embodiment, the quilt can be generally rectangular. The quilt 1 illustrated in FIGS. 1 and 2 is a "regular" size quilt adapted to fit users up to about 6 feet tall. It is understood, however, that the quilt can have any suitable size (e.g., shorter, longer, wider, narrower) and can be adapted specifically for men, women or youths.

The illustrated quilt 1 has an inner layer 11 (FIG. 2), an outer layer 13 (FIG. 1), and an insulation material (not shown) disposed between the inner and outer layers to provide warmth and softness to the quilt 1. The insulation material can be attached to the inner and/or outer layers 11, 13 of the shell using stitch-lines. It is understood that the inner and outer layers 11, 13 can be any suitable material (e.g., polyester). It is also understood that the inner layer 11 can be made from a different material than the outer layer 13. It is further understood that the insulation material can be any suitable material (e.g., goose down, CLOUDLOFT insulation, DRIDOWN insulation) and that the amount of insulation material can be selected to achieve the desired warmth and softness of the quilt 1.

With reference to FIG. 1, the quilt 1 includes a pair of longitudinally extending side edges 15, 17 and a pair of laterally extending end edges (i.e., a head end edge 19 and a foot end edge 21). In the illustrated embodiment, the left side edge 15 (as viewed in FIG. 1) is generally a mirror image of the right side edge 17. As seen in FIG. 1, the head end edge 19 has a length that is substantially greater than the foot end edge 21. In the illustrated embodiment, for example, the head end edge 19 has a length approximately three times the length of the foot end edge 21. It is understood however that the head end edge 19 and the foot end edge 21 can have any suitable lengths. For example, in one suitable example, the length of the head end edge 19 is substantially equal to the foot end edge 21.

As seen in FIG. 2, the side edges 15, 17 of the quilt 1 are not defined by lateral ends 23 of the quilt. Rather, the side edges 15, 17 are defined by longitudinally extending fold lines and the lateral ends 23 of the quilt 1 are spaced inward from the side edges 15, 17. More specifically, the quilt is folded longitudinally about the fold lines, which define the side edges 15, 17, so that the lateral ends 23 are spaced inward from the side edges to define overlapped portions, indicated generally at 25, of the quilt 1. In one suitable embodiment, the overlapped portions 25 extend along the entire longitudinal length of the quilt 1. That is, the overlapped portions 25 extend from the head end edge 19 to the foot end edge 21. In other suitable embodiments, the overlapped portions 25 extend a length less than the longitudinal length of the quilt 1. In one such embodiment, the overlapped portions 25 terminate in the foot portion 7. It is understood that the overlapped portions 25 can have any suitable length.

With reference still to FIG. 2, the overlapped portions 25 of the illustrated quilt 1 do not have a uniform width. Rather, the widths of the overlapped portions 25 vary along their length. In the illustrated embodiment, for example, each overlapped portion 25 has a first width W1 generally adjacent the head end edge 19; a second width W2 spaced longitudinally from the head end edge that is less than the first width; and a third W3 spaced longitudinally from and less than both the first and second widths. In the illustrated embodiment, for example, the first width W1 is approximately 9 inches, the second width W2 is approximately 7 inches, and the third width W3 is approximately 4 inches. It is contemplated that the overlapped portion 25 can have any suitable width (i.e., a constant width along its length) or widths.

In the illustrated embodiment, the overlapped portions 25 are held in place by stitching 27 but it is understood that the overlapped portions can be held in place using any suitable technique. As seen in FIG. 2, the overlapped portions 25 held in place by the stitching 27 define hand pockets 29 sized and shaped for receiving the hands of the user during use of the quilt 1. During use of the quilt 1, the user can insert his/her hands into the hand pockets 29 for warmth. The user is able to manually manipulate the quilt 1 while his/her hands are placed in the hand pockets 29. That is, the user is able to reconfigure or otherwise move the quilt 1 as desired using his/her hands while his/her hands are disposed within the hand pockets 29. The unstitched parts of the overlapped portions 25 disposed immediately below the hand pockets 29 define arm receptacles 31 sized and shaped for selectively receiving the arms of the user (see, e.g., FIGS. 11-13). In the illustrated embodiment, for example, the overlapped portions 25 and the arm receptacles 31 extend from the head portion 5 of the quilt through the middle portion 9 and terminate about halfway into the foot portion 7.

Figure 4:
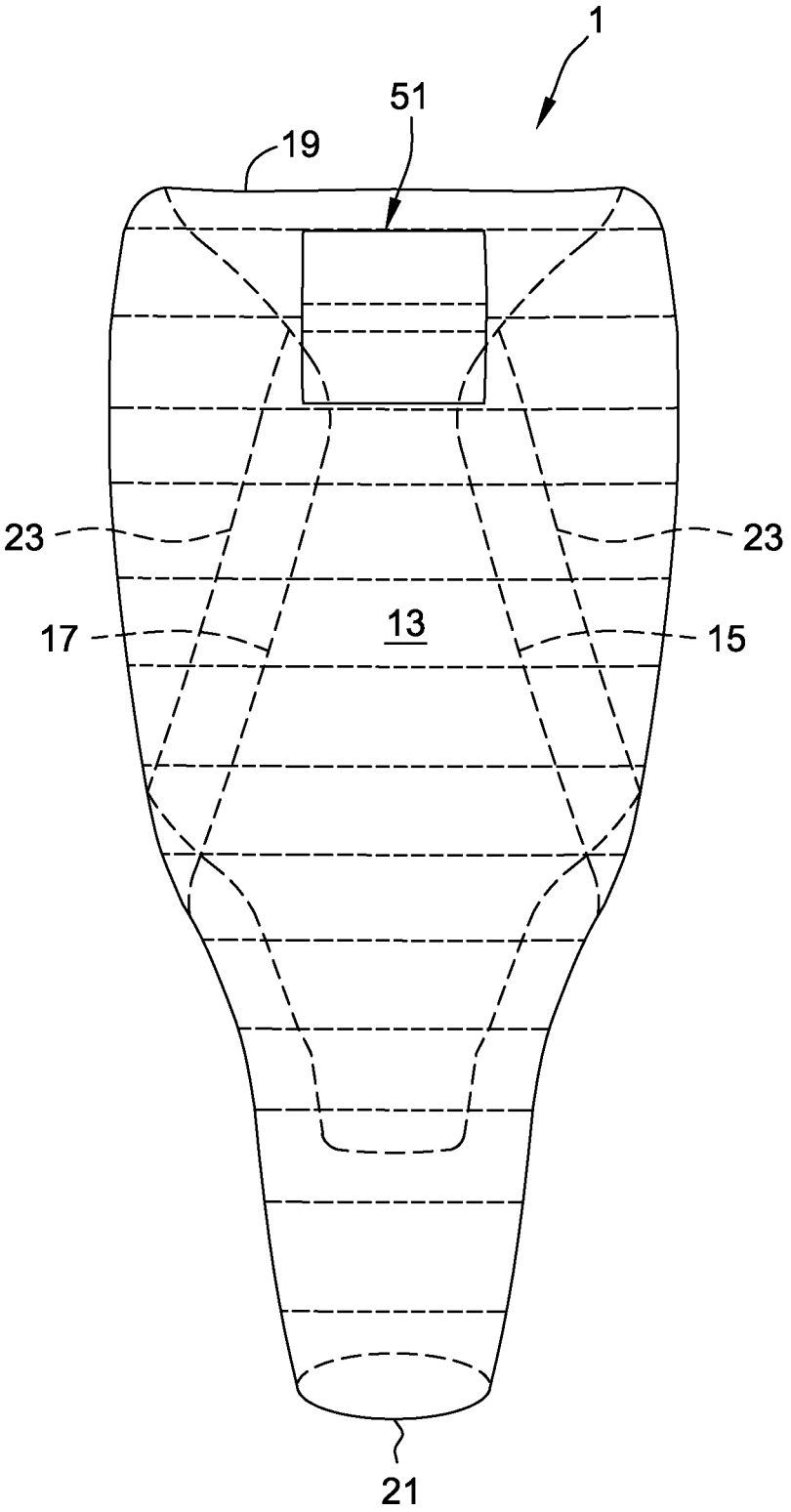
FIG. 4 is a top plan view of the quilt of FIG. 3 illustrating the sides of the quilt in a tucked position.
Figure 9:
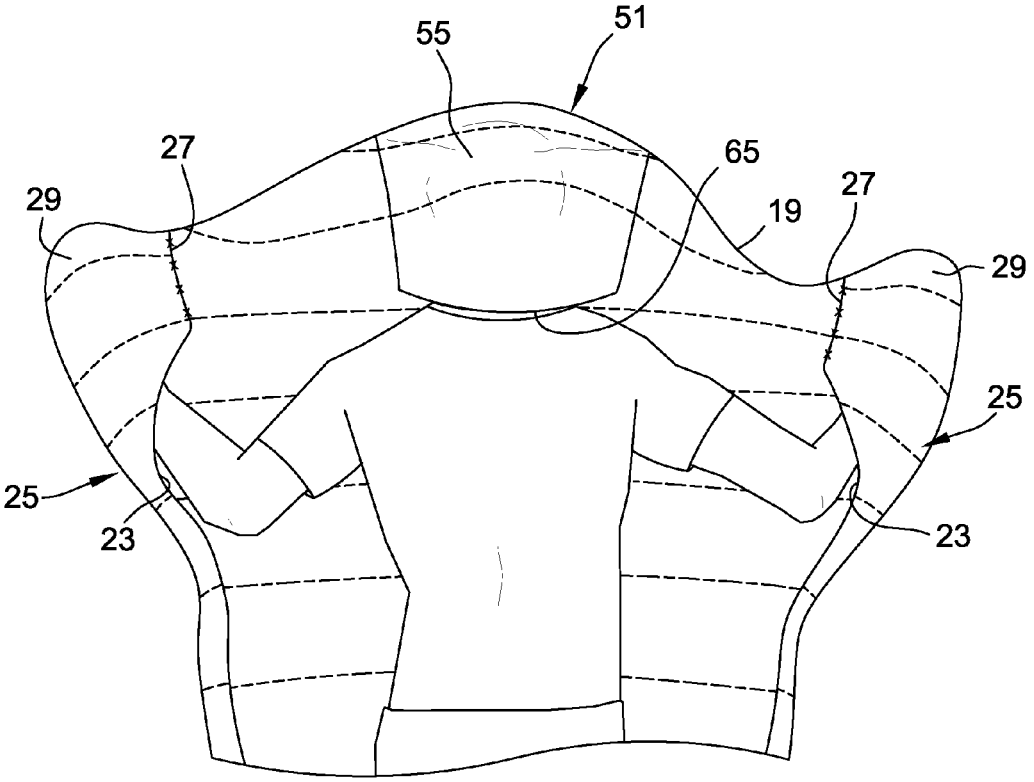
FIG. 9 is a partial bottom view of the quilt showing a user's head located in the hood box and the user's hands located in hand pockets of the quilt.

During use of the quilt, the overlapped portions 25 provide more warmth and comfort to the user as compared to a conventional quilt. For one, the user can place his/her hands into the hand pockets 29 and/or arms in the arm receptacles 31 (FIG. 9). This not only provides insulation to the hands and/or arms of the user but also inhibits the user's hand and/or arms from contact with an underlying surface (e.g., a sleeping pad/mat, ground, tent floor). Moreover, the overlapped portions 25 inhibit drafts (i.e., ambient air) from entering the quilt 1 along its side edges 15, 17. For example during use of the quilt 1, the user can place his/her hands into the hand pockets 29 and arms in the arm receptacles 31 and draw the quilt inward and tucked against their body as illustrated in FIG. 4. In such an example, the overlapped portions 25 generally seal against the underlying surface and inhibit drafts from entering the quilt along its side edges 15, 17.

As seen in FIG. 2, the illustrated quilt 1 includes a foot box (or pocket), indicated generally at 35, located in the foot portion 7 of the quilt 1 for selectively receiving the feet of the user during use. The foot box 35 has a foot panel 37 and a foot end panel 39. The foot panel 37 is attached (e.g., stitched) along its lateral side ends to the right and left side edges 15, 17 of the quilt 1 and along its lower longitudinal end to the foot end panel 39. The foot end panel 39 is also attached (e.g., stitched) to the foot end edge 21 of the quilt 1. It is understood that in some embodiments, the foot end panel 39 can be omitted and the lower longitudinal edge of the foot panel 37 can be attached (e.g., stitched) directly to the foot end edge 21 of the quilt 1. A proximate longitudinal end 41 of the foot panel 37 is unattached to thereby define an opening for allowing the user's feet ingress and egress to the foot box 35. It is understood that the foot box 35 can be omitted from some embodiments of the quilt 1 without departing from some aspects of this disclosure.

Figure 7:
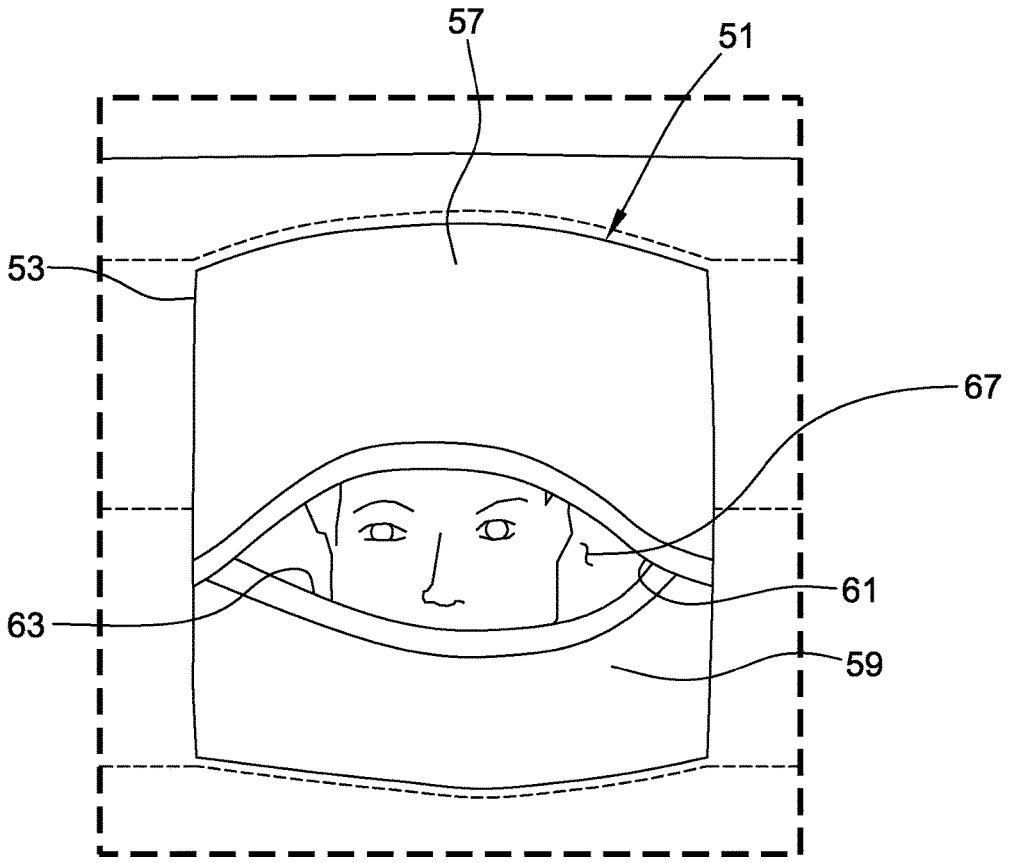
Figure 8:
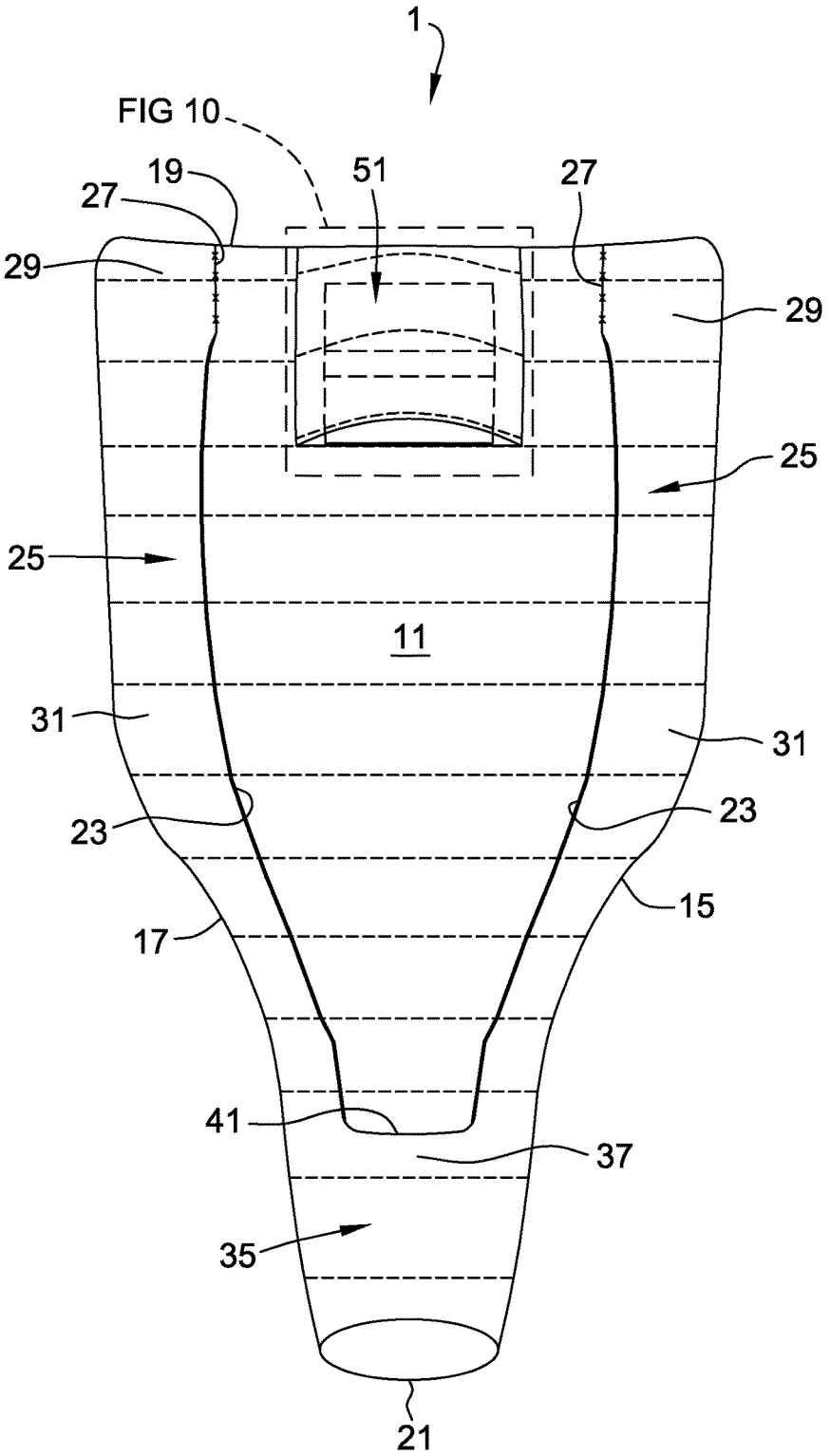
FIG. 8 is another bottom plan view of the quilt of FIG. 1.

As illustrated in FIGS. 1 and 2, a hood box, indicated generally at 51, is located in the head portion 5 of the quilt 1. The hood box 51 is adapted to selectively receive and surround the head of the user during use of the quilt 1 (FIGS. 7 and 9). As seen in FIGS. 1 and 2, the hood box 51 is disposed within the periphery of the quilt, which is defined by the side edges 15, 17, the head end edge 19, and the foot end edge 21. That is, no portion of the illustrated hood box 51 extends beyond the side edges 15, 17, the head end edge 19, and the foot end edge 21 of the quilt. It is understood that in other embodiments of the quilt 1, the hood box 51 could extend beyond the head end edge 19 of the quilt 1 without departing from some aspects of this disclosure.

Figure 5:
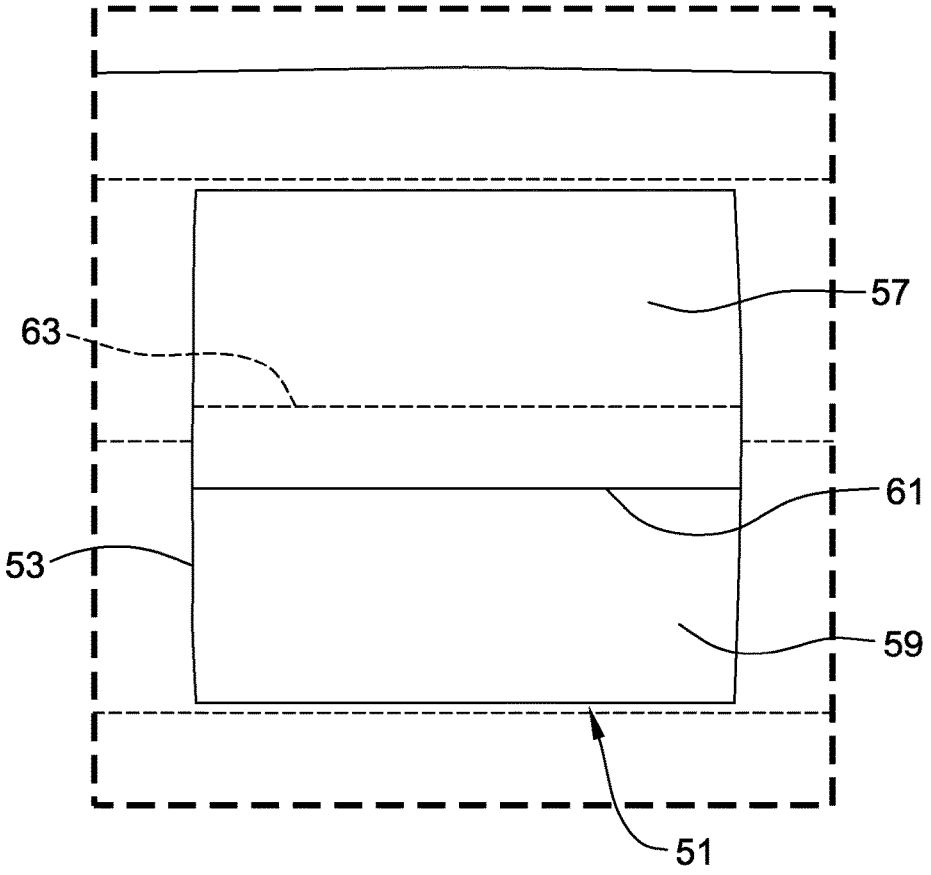
FIG. 5 is an enlarged view of a portion of the quilt identified in FIG. 3 illustrating a hood box of the quilt, an aperture in the hood box being in a closed position.

The hood box 51 comprises a front hood panel 53 (FIG. 1) and a back hood panel 55 (FIG. 2). With reference to FIG. 5, the front hood panel 53 includes an upper portion 57 and a lower portion 59. In the illustrated embodiment, the upper portion 57 is spaced inward from the head end edge 19 of the quilt. In the illustrated quilt, for example, the upper portion 57 of the front hood panel 53 is spaced about 3 inches from the head end edge 19 of the quilt. It is understood, however, that the upper portion 57 can be spaced from the head end edge 19 any suitable distance. It is also understood that the upper portion 57 can be aligned with the head end edge 19 as described in more detail below. The sides of the upper portion 57 are attached (e.g., stitched) to at least the outer layer 13. A lower edge 61 of the upper portion 57 is free (i.e., not attached). The lower portion 59 is attached (e.g., stitched) to at least the outer layer 13 along its lower edge and two sides. An upper edge 63 of the lower portion 59 is free (i.e., not attached). In the illustrated embodiment, the lower edge 61 of the upper portion 57 overlaps the upper edge 63 of the lower portion 59 by about 3 inches. In other words, the lower edge 61 of the upper portion 57 is spaced approximately 3 inches beyond the upper edge 63 of the lower portion 59. It is understood, however, that the upper portion 57 can overlap the lower portion 59 by any suitable distance. It is contemplated that in other embodiments of the quilt, the lower portion 59 can overlap the upper portion 57. It is also contemplated that the lower edge 61 of the upper portion 57 can be in end-to-end engagement with the upper edge 63 of the lower portion 59.

Figure 6:
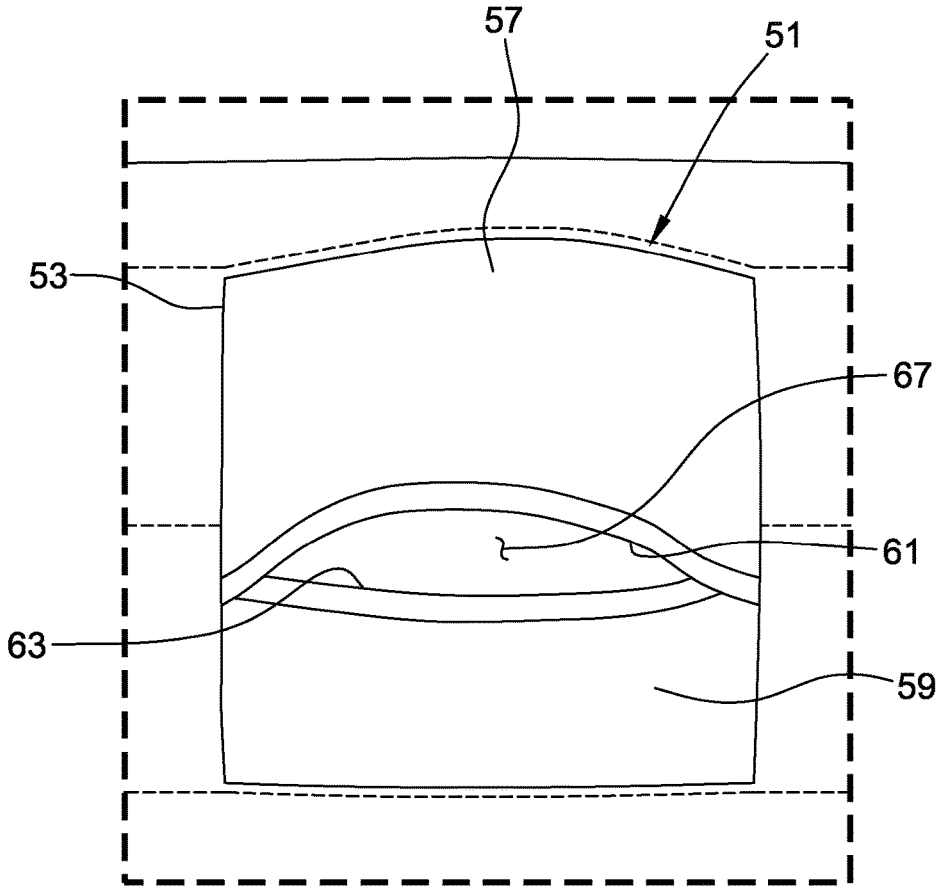
FIGS. 6 and 7 are enlarged views similar to FIG. 5 but illustrating the aperture of the hood box in an opened configuration.

The lower edge 61 of the upper portion 57 can be selectively moved relative the upper edge 63 of the lower portion 59 from a closed, sealed position illustrated in FIG. 5 to an opened position illustrated in FIGS. 6 and 7. As seen in FIGS. 6 and 7, the opened position provides an aperture 67 in the front hood panel 53 suitable for allowing at least a portion of the user's face to be exposed (i.e., uncovered by the front hood panel). Suitably in the opened position, the lower edge 61 of the upper portion 57 can rest against the user's forehead above their eyes and the upper edge 63 of the lower portion 59 can be tucked beneath the user's chin. Alternately, as seen in FIG. 9, the lower edge 61 of the upper portion 57 can rest against the user's forehead just above the eyes of the user and the upper edge 63 of the lower portion 59 can be positioned just below the user's nose. The relative positions and thus the size of the aperture 67 can be manually adjusted by the user by spacing the lower edge 61 of the upper portion 57 from the upper edge 63 of the lower portion 59 as desired. Upon removal of the user's head from the hood box 51, the lower edge 61 of the upper portion 57 will overlap the upper edge 63 of the lower portion 59 thus returning the hood box 51 to its closed, sealed position.

Figure 10:
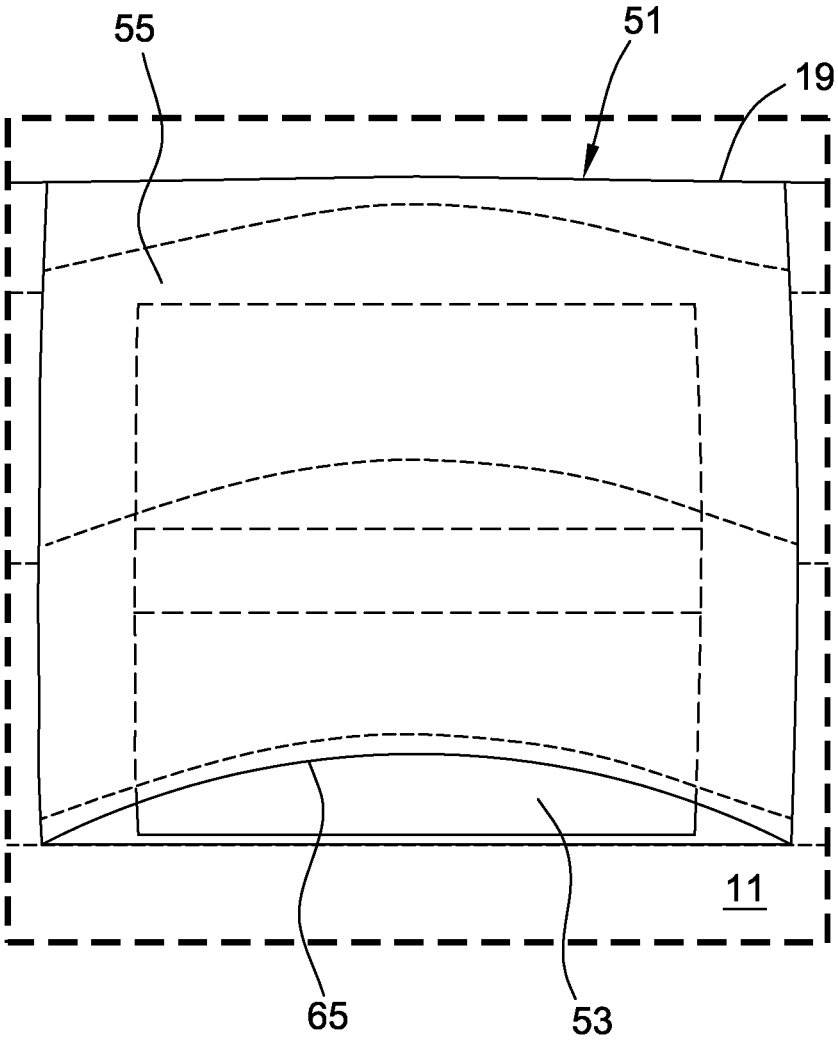
FIG. 10 is an enlarged view of a portion of the quilt identified in FIG. 8 illustrating the hood box of the quilt.
Figure 11:
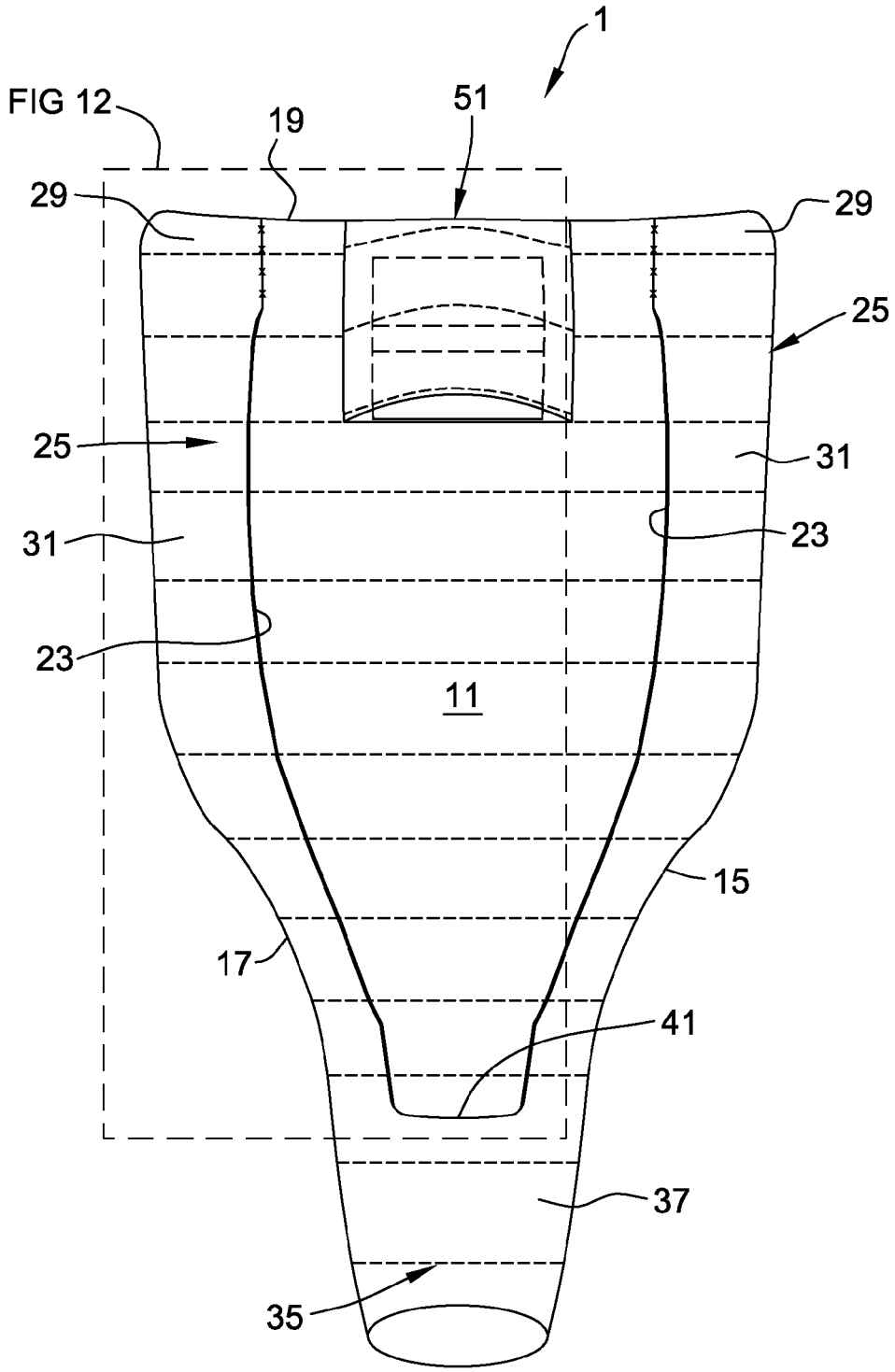
FIG. 11 is yet another bottom plan view of the quilt of FIG. 1, the quilt having a foot box, a hand pocket and an arm flap extending between the foot box and the hand pocket.
Figure 12:
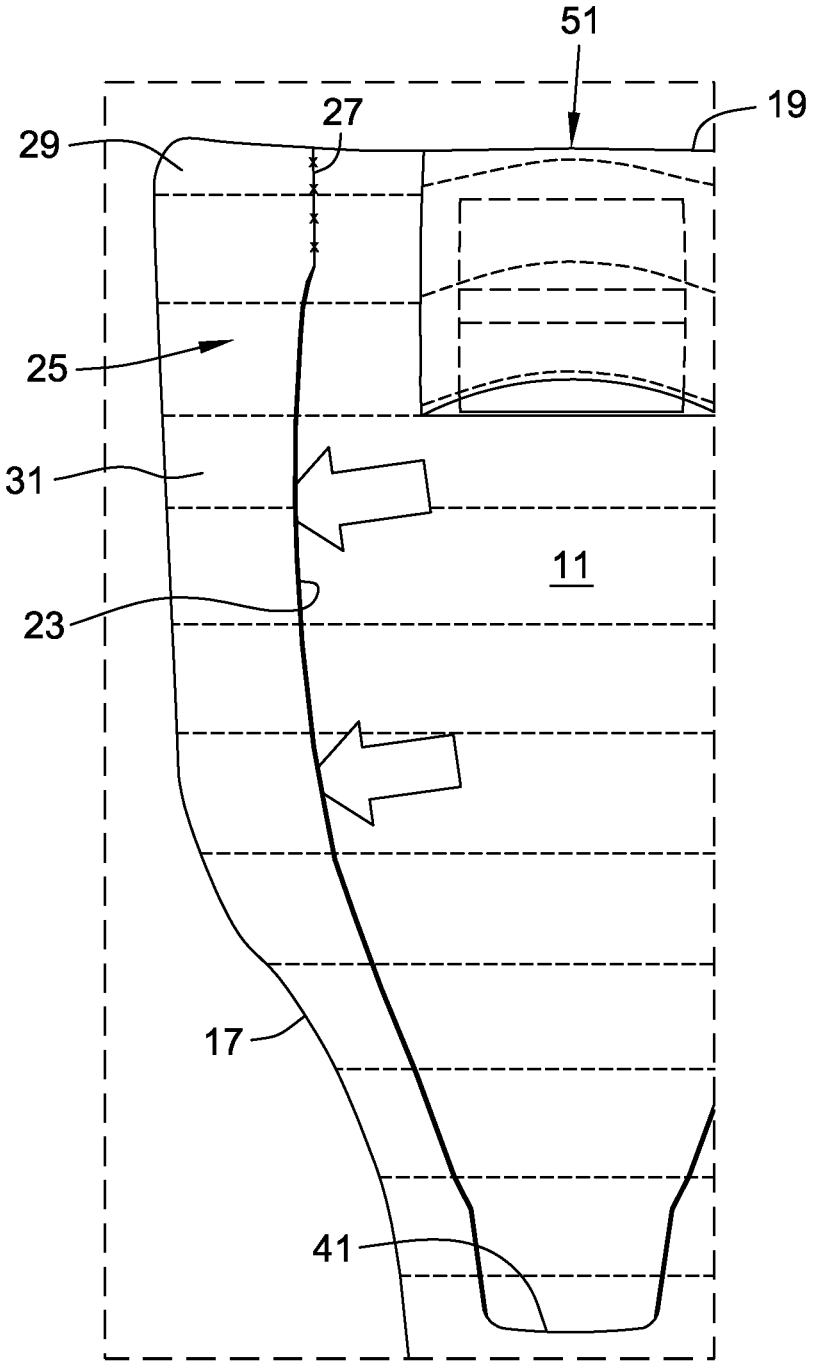
FIG. 12 is an enlarged bottom plan view illustrating a portion of the quilt of FIG. 11, the arrows indicating an overlapped portion of the quilt defining the hand pocket and the arm flap.
Figure 13:
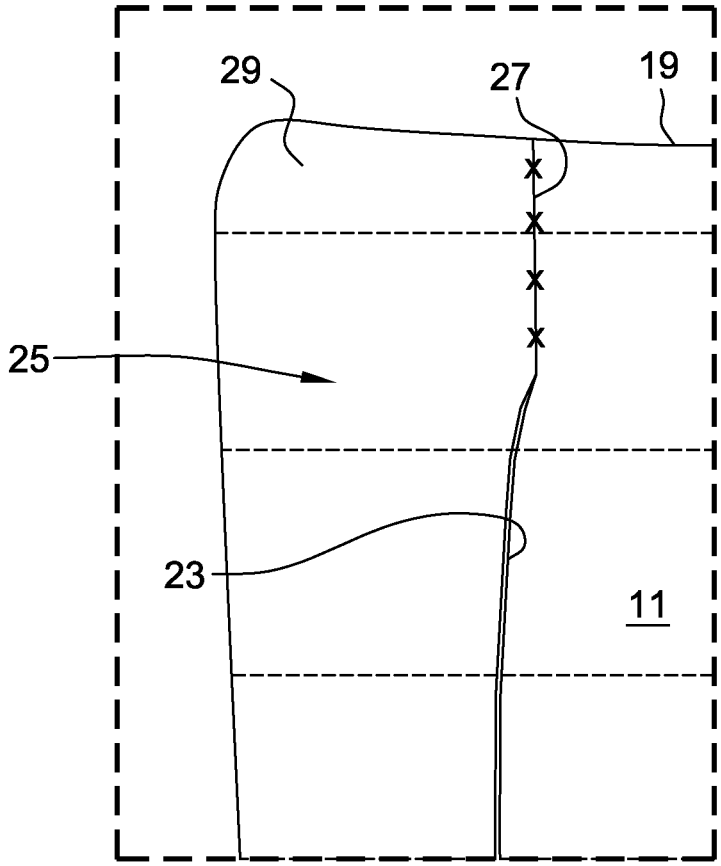
FIG. 13 is an enlarged bottom plan view illustrating a portion of the quilt of FIG. 12.

As seen in FIG. 10, the back hood panel 55 is generally aligned with and attached (e.g., stitched) to the head end edge 19 of the quilt. The sides of the back hood panel 55 are attached (e.g., stitched) to at least the inner layer 11 of the quilt 1. The distal or lower edge 65 of the back hood panel 55 is free (i.e., not attached). In the illustrated embodiment, the lower edge 65 is generally arcuate but it is understood that the lower edge can have any suitable shape. The lower edge 65 of the back hood panel 55 can be selectively spaced from the front hood panel 53 to define an opening for receiving the user's head during use of the quilt. That is, the user can slide their head past the lower edge 65 of the back hood panel 55 and into an interior space of the hood box 51 wherein the user's head is substantially covered by the hood box as seen in FIG. 9. The arcuate lower edge 65 of the back hood panel 55 generally rests or otherwise contacts the shoulders of the user when the user's head is inserted into the hood box 51.

Figure 14:
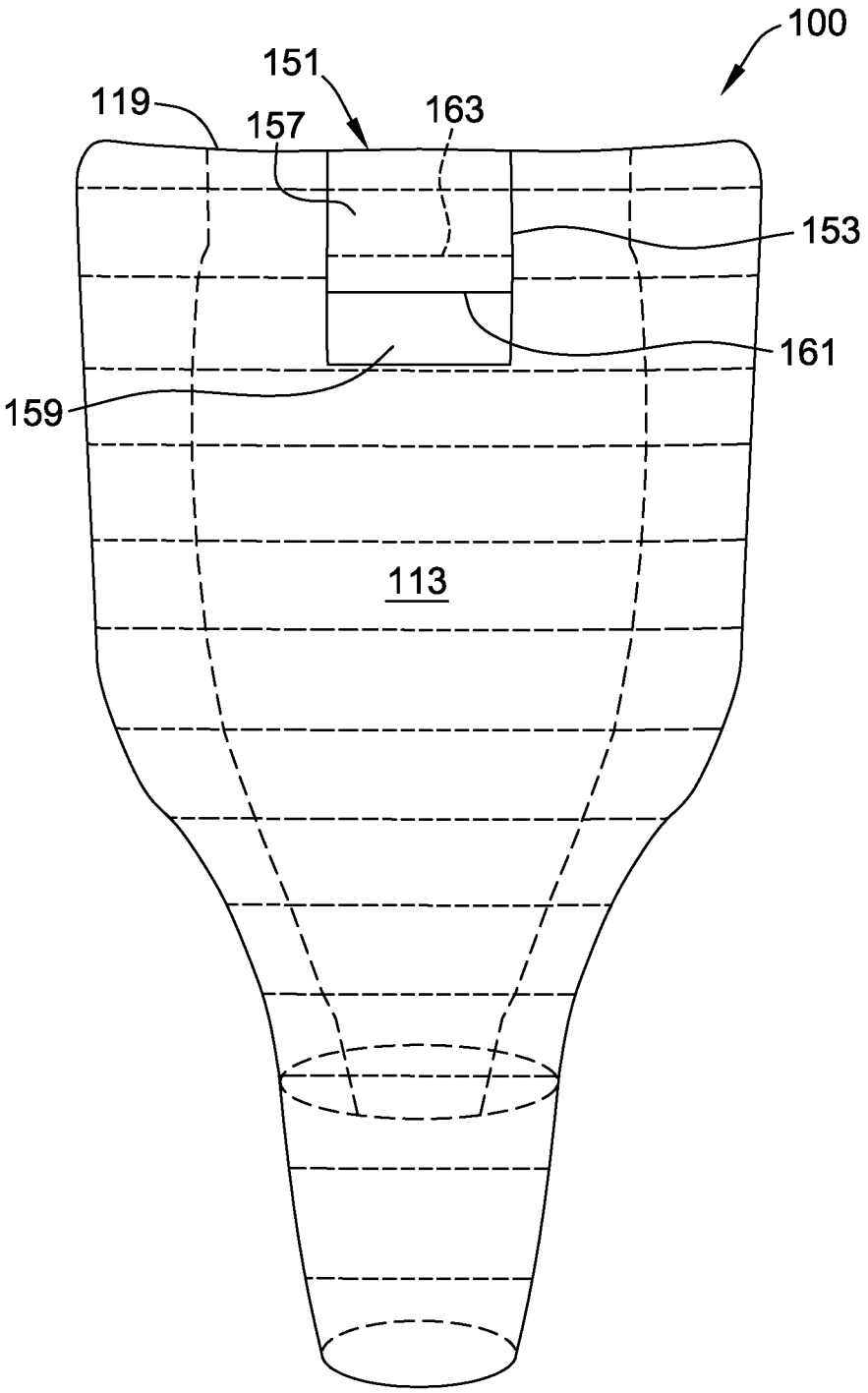
FIG. 14 is a top plan view of another embodiment of a quilt.
Figure 15:
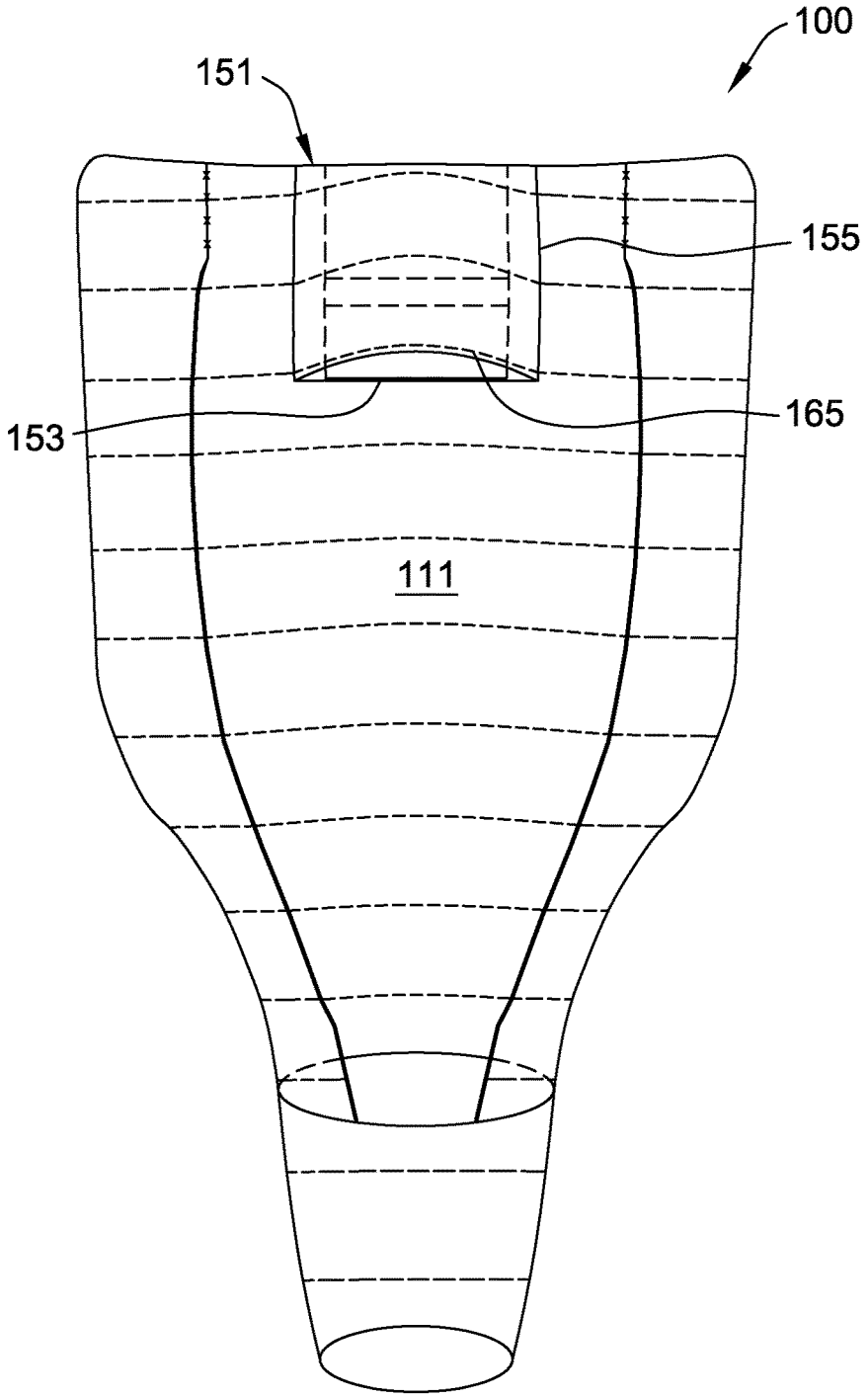
FIG. 15 is a bottom plan view of the quilt of FIG. 14.

FIGS. 14 and 15 illustrate another embodiment of a quilt, indicated generally at 100, that is similar to the embodiment illustrated in FIGS. 1-13 and described above but having a different hood box configuration. This embodiment has a hood box, indicated generally at 151, located in the head portion of the quilt 100. The hood box 151 is adapted to selectively receive and surround the head of the user during use of the quilt 100. The hood box 151 comprises a front hood panel 153 (FIG. 14) and a back hood panel 155 (FIG. 15). With reference to FIG. 14, the front hood panel 153 includes an upper portion 157 and a lower portion 159. In this embodiment, the upper portion 157 is generally aligned with and attached (e.g., stitched) to a head end edge 119 of the quilt. The sides of the upper portion 157 are attached (e.g., stitched) to at least an outer layer 113 of the quilt 100. A lower edge 161 of the upper portion 157 is free (i.e., not attached). The lower portion 159 is attached (e.g., stitched) to at least the outer layer 113 along its lower edge and two sides. An upper edge 163 of the lower portion 159 is free (i.e., not attached).

In the illustrated embodiment, the lower edge 161 of the upper portion 157 overlaps the upper edge 163 of the lower portion 159 by about 3 inches. It is understood that the upper portion 157 can overlap the lower portion 159 by any suitable distance. It is contemplated that in other embodiments of the quilt, the lower portion 159 can overlap the upper portion 157. It is also contemplated that the lower edge 161 of the upper portion 157 can be in end-to-end engagement with the upper edge 163 of the lower portion 159.

The lower edge 161 of the upper portion 157 can be selectively moved relative to the upper edge 163 of the lower portion 159 from a closed, sealed position illustrated in FIG. 14 to an opened position. As in the embodiment illustrated in FIGS. 1-13, the opened position provides an aperture in the front hood panel 153 suitable for allowing at least a portion of the user's face to be exposed (i.e., uncovered by the front hood panel). Suitably in the opened position, the lower edge 161 of the upper portion 157 can rest against the user's forehead above his/her eyes and the upper edge 163 of the lower portion 159 can be tucked beneath the user's chin or positioned just below the user's nose. The user can manually adjust the size of the aperture 167 by spacing the lower edge 161 of the upper portion 157 from the upper edge 163 of the lower portion 159 as desired.

As seen in FIG. 15, the back hood panel 155 is generally aligned with and attached (e.g., stitched) to the head end edge 119 of the quilt. The sides of the back hood panel 155 are attached (e.g., stitched) to at least an inner layer 111 of the quilt 100. The distal or lower edge 165 of the back hood panel 155 is free (i.e., not attached). In the illustrated embodiment, the lower edge 165 is generally arcuate but it is understood that the lower edge can have any suitable shape. The lower edge 165 of the back hood panel 155 can be selectively spaced from the front hood panel 153 to define an opening for receiving the user's head during use of the quilt. That is, the user can slide their head past the lower edge 165 of the back hood panel 155 and into an interior space of the hood box 151 wherein the user's head is substantially covered by the hood box.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions without departing from the scope of the invention, it is intended that all matter contained in the above description and shown in the accompanying drawings shall be interpreted as illustrative and not in a limiting sense.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A quilt comprising:

an inner layer;

an outer layer; and a hood box comprising a front hood panel attached to the outer layer and a back hood panel attached to the inner layer, the back hood panel having an opening defined through the inner layer and sized and shaped for allowing a user's head to be placed into and withdrawn from the hood box, and the front hood panel having an aperture selectively moveable between a closed position and an opened position, wherein the front hood panel comprises an upper portion having a free lower edge and a lower portion having a free upper edge, the free lower edge and the free upper edge defining the aperture; and the back hood panel comprises another free lower edge at least in part defining the opening sized and shaped for allowing the user's head to be placed into and withdrawn from the hood box such that the aperture is positioned above the other free lower edge of the back hood panel and the opening is positioned below the free upper edge of the front hood panel.

2. The quilt as set forth in claim 1 wherein the upper portion contacts the lower portion in the closed position of the aperture and the free lower edge of the upper portion being spaced from the free upper edge of the lower portion in the opened position of the aperture.

3. The quilt as set forth in claim 2 wherein the free lower edge of the upper portion overlaps and extends beyond the free upper edge of the lower portion in the closed position of the aperture.

4. The quilt as set forth in claim 1 wherein the free lower edge of the back hood panel is generally arcuate.

5. A quilt having an inner layer, an outer layer, a head portion, a foot portion, and a middle portion extending longitudinally between the head and foot portions, the quilt comprising:

a hood box attached to the inner layer and the outer layer and adapted to receive and surround a head of a user during use of the quilt, the hood box being disposed in the head portion and including a front hood panel and a back hood panel spaced from the front hood panel to define an interior between the front hood panel and the back hood panel, the back hood panel has a width greater than or equal to a width of the front hood panel, the front hood panel having an aperture moveable between a closed position and an opened position for allowing at least a portion of a user's face to be exposed during use of the quilt, and the back hood panel defining an opening sized and shaped for allowing the user's head to be placed into the interior such that the back hood panel surrounds the user's head and for allowing the user's head to be withdrawn from the interior and out of the hood box.

6. The quilt set forth in claim 5 further comprising a periphery defined by a pair of longitudinally extending side edges and a pair of laterally extending end edges, the hood box being located within the periphery of the quilt.

7. The quilt set forth in claim 5 further comprising a pair of laterally extending end edges, a head end edge and a foot end edge in the head and foot portions respectively, the hood box being aligned with the head end edge.

8. The quilt set forth in claim 5 further comprising a foot box sized and shaped for selectively receiving at least one foot of the user during use.

9. The quilt set forth in claim 5 further comprising an inner layer, an outer layer, and an insulation material disposed between the inner and outer layers.

10. The quilt as set forth in claim 5 wherein the front hood panel comprises an upper portion having a free lower edge and a lower portion having a free upper edge, the upper portion contacting the lower portion in the closed position of the aperture and the free lower edge of the upper portion being spaced from the free upper edge of the lower portion in the opened position of the aperture.

11. The quilt as set forth in claim 10 wherein the free lower edge of the upper portion overlaps the free upper edge of the lower portion in the closed position of the aperture.

12. The quilt as set forth in claim 5 wherein the back hood panel comprises a free lower edge at least in part defining the opening sized and shaped for allowing the user's head to be placed into and withdrawn from the hood box.

13. The quilt as set forth in claim 12 wherein the free lower edge of the back hood panel is generally arcuate.

14. A quilt comprising:

a head portion, a middle portion, and a foot portion;

the head portion having a width defined by a head end edge extending between opposing corners of said head portion and the foot portion having a width defined by an opposing foot end edge, the width of the head portion being greater than the width of the foot portion;

a generally rectangular hood box comprising a front hood panel and a back hood panel, the back hood panel comprising a free lower edge at least in part defining an opening sized and shaped for allowing a user's head to be placed into and withdrawn from the hood box, and the front hood panel having an aperture selectively moveable between a closed position and an opened position, wherein the front hood panel comprises an upper portion having a free lower edge and a lower portion having a free upper edge such that the free lower edge of the upper portion extends beyond the free upper edge of the lower portion, the free lower edge and the free upper edge of the front hood panel together defining the aperture selectively movable between the closed and opened positions;

the back hood panel having an overall width greater than an overall width of the front hood panel, the width of the back hood panel being substantially equal to the width of foot portion and less than the width of the head portion; and the back hood panel having an upper edge flush with the head end edge and the front hood panel having an upper edge spaced from the head end edge.

* * * * *